US008600093B2

(12) United States Patent
Yoshino

(10) Patent No.: US 8,600,093 B2
(45) Date of Patent: Dec. 3, 2013

(54) CAPACITOR MICROPHONE

(75) Inventor: Satoshi Yoshino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 512 days.

(21) Appl. No.: 12/872,407

(22) Filed: Aug. 31, 2010

(65) Prior Publication Data

US 2011/0058695 A1 Mar. 10, 2011

(30) Foreign Application Priority Data

Sep. 4, 2009 (JP) ..... 2009-205050

(51) Int. Cl.
*H04R 9/08* (2006.01)

(52) U.S. Cl.
USPC ..... 381/355; 381/361; 381/369; 381/174; 381/391

(58) Field of Classification Search
USPC ..... 381/391, 355, 361, 369, 174
See application file for complete search history.

(56) References Cited

U.S. PATENT DOCUMENTS

| | | | | |
|---|---|---|---|---|
| 6,128,385 | A * | 10/2000 | Goyal et al. | 379/433.01 |
| 7,280,855 | B2 * | 10/2007 | Hawker et al. | 455/575.1 |
| 2005/0281429 | A1 * | 12/2005 | Rivera | 381/391 |
| 2006/0050917 | A1 * | 3/2006 | Skillicorn et al. | 381/384 |

FOREIGN PATENT DOCUMENTS

| | | | |
|---|---|---|---|
| JP | 39-014404 | U | 5/1964 |
| JP | 01-177687 | U | 12/1989 |
| JP | 2006-166078 | A | 6/2006 |
| JP | 2006-222641 | A | 8/2006 |
| JP | 2008-166909 | | 7/2008 |

* cited by examiner

*Primary Examiner* — Davetta W Goins
*Assistant Examiner* — Amir Etesam
(74) *Attorney, Agent, or Firm* — Whitham Curtis Christofferson & Cook, PC

(57) ABSTRACT

A capacitor microphone includes: a capacitor microphone unit; a microphone casing that incorporates the microphone unit and is provided with an opening communicating with a rear acoustic terminal of the microphone unit; and a shield plate that covers the opening in the microphone casing from inside of the microphone casing. The shield plate has a projection extending towards axial direction of the microphone casing at least on microphone unit side in the axial direction of the microphone casing. The projection is folded to be pressed firmly against the outer surface of a casing of the capacitor microphone unit. The shield plate is rolled into a cylindrical shape and is in contact with the inner surface of the microphone casing with pressure.

8 Claims, 7 Drawing Sheets

RELATED ART

RELATED ART

RELATED ART

RELATED ART

CAPACITOR MICROPHONE

BACKGROUND OF THE INVENTION

1. Field of the Invention

The present invention relates to a capacitor microphone unique in its shielding structure against electromagnetic wave at a rear acoustic terminal portion.

2. Description of the Related Art

In a capacitor microphone, an impedance converter, typically a field-effect transistor (FET), is disposed nearby a signal output unit of a microphone unit. A signal is output from the microphone with high output impedance of the microphone unit lowered by the impedance converter.

For example, in a unidirectional capacitor microphone, sound waves need to be introduced through a rear acoustic terminal of a microphone unit. Therefore, a casing of the microphone is provided with an opening through which sound waves are introduced to the rear acoustic terminal of the microphone unit. If a signal output unit of the microphone unit is disposed at a position corresponding to the opening, an electromagnetic wave entering the opening from exterior is detected by the impedance converter, i.e., the FET, to be mixed into an output signal of the microphone as noise. Such noise includes hum noise with low frequency attributable to commercial AC source and noise with relatively high frequency attributable to broad cast electromagnetic wave. In addition, generation of noise having extremely high frequency attributable to electromagnetic waves from cell phones that is becoming more frequently used around microphones has recently become a serious problem.

Countermeasures against electromagnetic waves entering the opening through which sound waves are introduced to the rear acoustic terminal in a conventional capacitor microphone have met with limited success. Deficiency of the conventional countermeasures against electromagnetic waves is described below with reference to an exemplary structure of a conventional microphone.

FIG. 4A is an external view exemplary illustrating a typical gooseneck capacitor microphone. FIG. 4B is an external view exemplary illustrating a typical microphone to which a cable is directly connected. In the gooseneck microphone illustrated in FIG. 4A, ends of a flexible pipe 53 is connected to a base end of a casing 51 of a microphone 50 and to a connector 54, respectively. The microphone casing 51 incorporates a capacitor microphone unit. A cable extending from the microphone unit passes through the internal space of the flexible pipe 53 and is electrically connected to a connection terminal of the connector 54. The connector 54 physically fixed to a base (not illustrated) allows the microphone to vertically stand by the flexible pipe 53. The microphone cable can be extended to the exterior via the connector 54 or the cable connector in connection to the connector 54. The microphone casing 51 is provided with an opening 52 through which the rear acoustic terminal of the capacitor microphone unit is communicated with the exterior space.

In the microphone exemplary illustrated in FIG. 4B, a microphone cable 55 extends from the base end of the microphone casing 51 of the capacitor microphone 50 directly or with a connector provided at one end of the microphone cable 55 being connected to thereto. The other end of the microphone cable 55 is provided with a connector 56. An appropriate external device connected to the connector 56 can receive an output signal from the microphone unit. The microphone casing 51 is provided with an opening 52 through which the rear acoustic terminal of the capacitor microphone unit is communicated with the external space.

FIGS. 5A and 5B each exemplary illustrates an internal structure of the capacitor microphone 50. Each of the conventional examples illustrated in FIGS. 5A and 5B includes the microphone casing 51 of a cylindrical shape in which the front end is provided with an endplate and the rear end is opened. The microphone casing 51 incorporates a damper 56 provided along the inner surface of the endplate in the microphone casing 51 and a capacitor microphone unit 57 disposed in the microphone casing 51 in a manner that the damper 56 is pressed against the inner surface of the endplate therewith. The microphone unit 57 is provided with a rear acoustic terminal for the microphone 50 to have unidirectionality. Internal structure of the capacitor microphone unit 57 is described later. The rear acoustic terminal of the capacitor microphone unit 57 is communicated with the external space through multiple openings 52 provided at portions near the front end of the microphone casing 51. An area of the inner surface of the microphone casing 51 including the portions at which the openings 52 are formed is provided with a shield mesh 60 illustrated in FIG. 5C. The shield mesh 60 is made of stainless metal wires having a diameter of about 0.1 mm and is formed into a cylindrical shape that matches the inner surface of the microphone casing 51 to be fixed thereto.

In the structure exemplary illustrated in FIG. 5B, a circuit substrate 58 is fixed inside the microphone casing 51. An output signal terminal of the microphone unit 57 is connected to a certain wiring pattern on the circuit substrate 58. Multiple wires forming the cable 55 are connected to a wiring pattern on the rear end portion of the circuit substrate 58. The cable 55 formed of the multiple wires extends to the exterior through a bush fitted at the opening end of the microphone casing 51.

In the structure exemplary illustrated in FIG. 5A, the wires forming the microphone cable 55 are connected to the circuit substrate of the microphone unit 57. The cable 55 extends to the exterior through the bush fitted at the opening end of the microphone casing 51.

FIG. 6 is an enlarged view of the main part of the capacitor microphone 50, i.e., the capacitor microphone unit 57 and an area therearound. In FIG. 6, the microphone unit 57 includes a unit casing 70 having bottomed cylindrical shape. The microphone unit 57 further includes a diaphragm 64 fixed to a holding ring to be held thereby, a fixed electrode 65 facing the diaphragm 64 with a slight space therebetween, an insulating holder 66 through which pressing force towards the inner bottom surface of the unit casing 70 is applied to the fixed electrode 65 and the holding ring, and a circuit substrate 67 through which the pressing force is applied to the insulating holder 66, all of which are incorporated in the unit casing 70. The opening end of the unit casing 70 is folded in the inner peripheral direction to be a folded portion 71. The folded portion 71 applies pressing force to the periphery of the circuit substrate 67. Thus, the elements incorporated in the unit casing 70 are pressed against the inner bottom surface of the unit casing 70. As a result, the above listed elements are rigidly positioned. A FET 68 serving as an impedance converter is connected to the circuit substrate 67 and is surrounded by a relief hole formed in the insulating holder 66. The flat portion, i.e., the bottom portion of the unit casing 70 is provided with an opening forming a front acoustic terminal. The insulating holder 66 is provided with a rear acoustic terminal 69 through which an air chamber formed between the diaphragm 64 and the fixed electrode 65 is communicated to the exterior and in which an acoustic resistor is provided. The above described structure of the capacitor microphone unit 57 is commonly used and thus is not innovative.

In the structure illustrated in FIG. 6, the circuit substrate 58 is fixed inside the microphone casing 51 as in the structure illustrated in FIG. 5B. The circuit substrates 58 and 67 are perpendicular to each other. A certain circuit pattern on the circuit substrate 58 is soldered to a certain circuit pattern on the circuit substrate 67 on the microphone unit 57 side with one end of the circuit substrate 58 orthogonally abutting contact with the outer side surface of the circuit substrate 67.

The above described conventional capacitor microphone is shielded from electromagnetic waves by covering the openings 52 formed on the microphone casing 51 to achieve unidirectionality from the inside using the shield mesh 60. The shield mesh 60 is made by weaving metallic wires having diameters of about 0.1 mm in the longitudinal and lateral directions as described above. Thus, electrical connection is made at contact portions between the lateral wires and the longitudinal wires. Unfortunately, the shield mesh 60 cannot provide sufficient shielding effect because electrically connected states among the contact points are not uniform. The shield mesh 60 is rolled into a cylinder and is inserted in the microphone casing 51 to be fixed thereto using adhesive. The contact pressure of the shield mesh 60 against the microphone casing 51 may not be high enough to provide sufficient shielding effect.

An output signal of the microphone unit 57 is output directly through the wires as illustrated in FIG. 5A, or is output through the circuit substrate 58 as illustrated in FIG. 5B. The ground portion of the microphone unit 57 is connected to the microphone casing. 51 via the wire or via the circuit substrate 58 and is not directly connected to the microphone casing 51 because a space needs to be provided therebetween. Furthermore, the damper 56 is provided between the front surface of the microphone unit 57 and the inner surface of the endplate serving as the bottom plate of the microphone casing 51. The damper 56 serves as an acoustic resister, a wind screen, and a cushion for the microphone unit 57 against the microphone casing 51.

Typically, in the capacitor microphone unit 57, the circuit substrate 67 on which the FET 68 is mounted fits the opening end of the unit casing 70 incorporating the required elements as illustrated in FIG. 6. The circuit substrate 67 is pressed by the folded portion 71, which is the opening end portion of the unit casing 70 folded inward. Thus, the elements are positioned. In some cases, pressing force towards the circuit substrate 67 of the microphone unit 57 is applied to the wires or the circuit substrate 58 both of which are electrically connected to the circuit substrate 67. If the pressing force is high enough to compress the damper 56, the circuit substrate 67 is separated from the folded portion 71 of the capacitor microphone unit casing 70 as illustrated in FIG. 7. The ground pattern of the circuit substrate 67 is grounded by being in contact with the folded portion 71. Therefore, the above described separation of the circuit substrate 67 from the folded portion 71 of the unit casing 70 hampers the grounded state of the circuit substrate 67 thereby leading to insufficient shielding for the microphone unit 57.

If, on the other hand, the circuit substrate 67 of the microphone unit 57 is applied with pulling force via the wires or the circuit substrate 58, the microphone unit 57 is pulled to the rear direction to increase the distance between the front surface of the microphone unit 57 and the inner surface of the bottom plate of the microphone casing 51. Thus, the front acoustic terminal is widened to cause change in sound quality.

Applicant of the present application has filed Japanese Patent Application Publication 2008-166909 in which an invention is disclosed that can address the problem of the shield for the openings formed in the microphone casing 51, which is one of the above described problems of the conventional capacitor microphone. Specifically, a coil spring is disposed in the microphone casing and the metallic mesh that covers the openings serving as the rear acoustic terminal of the microphone casing from the inside is pressed against the inner wall surface of the microphone casing with the spring force of the coil spring. Thus, the metallic mesh can be surely pressed against the openings of the microphone casing to improve the shielding effect for the openings.

The invention disclosed in Japanese Patent Application Publication 2008-166909 can provide the above described effect. However, the technique, which can provide the shielding effect for the openings of the microphone casing to some extent, still has rooms for improvement because no consideration is made for the shielding effect due to the electrical connection between the casings of microphone unit and the microphone. In addition, no consideration is made for the degradation of the shielding effect and change in sound quality due to pressing force and pulling force applied to the microphone unit, respectively.

SUMMARY OF THE INVENTION

An object of the present invention is to provide a capacitor microphone that can solve the above problems in the conventional technique, that is, a capacitor microphone that can have improved shielding effect for the opening of the microphone casing while further improving the shielding effect of the microphone unit by improving the electrical connection between the casings of the microphone unit and the microphone, and can prevent the degradation of the shielding effect and the change in sound quality due to the force applied to the microphone unit.

A capacitor microphone according to the present invention includes: a capacitor microphone unit; a microphone casing that incorporates the microphone unit and is provided with an opening communicating with a rear acoustic terminal of the microphone unit; and a shield plate that covers the opening in the microphone casing from inside of the microphone casing. The shield plate has a projection extending towards axial direction of the microphone casing at least on microphone unit side in the axial direction of the microphone casing. The projection is folded to be pressed firmly against the outer surface of a casing of the capacitor microphone unit.

The opening of the microphone casing is covered With the shield plate from the inside of the microphone casing. Thus, electromagnetic waves are prevented from entering through the opening. The projection of the shield plate is folded in the direction to be pressed firmly against the outer surface of the casing of the microphone unit. Therefore, the casing of the microphone unit and the microphone casing are electrically connected with each other to improve the shielding effect of the microphone unit. The movement of the microphone unit in a radial direction as well as in an axial direction is restricted with the projection in contact with the outer surface of the casing of the microphone unit.

DETAILED DESCRIPTION OF THE PREFERRED EMBODIMENTS

An embodiment of the capacitor microphone according to the present invention is described below with reference to some of the figures.

Figure 1:
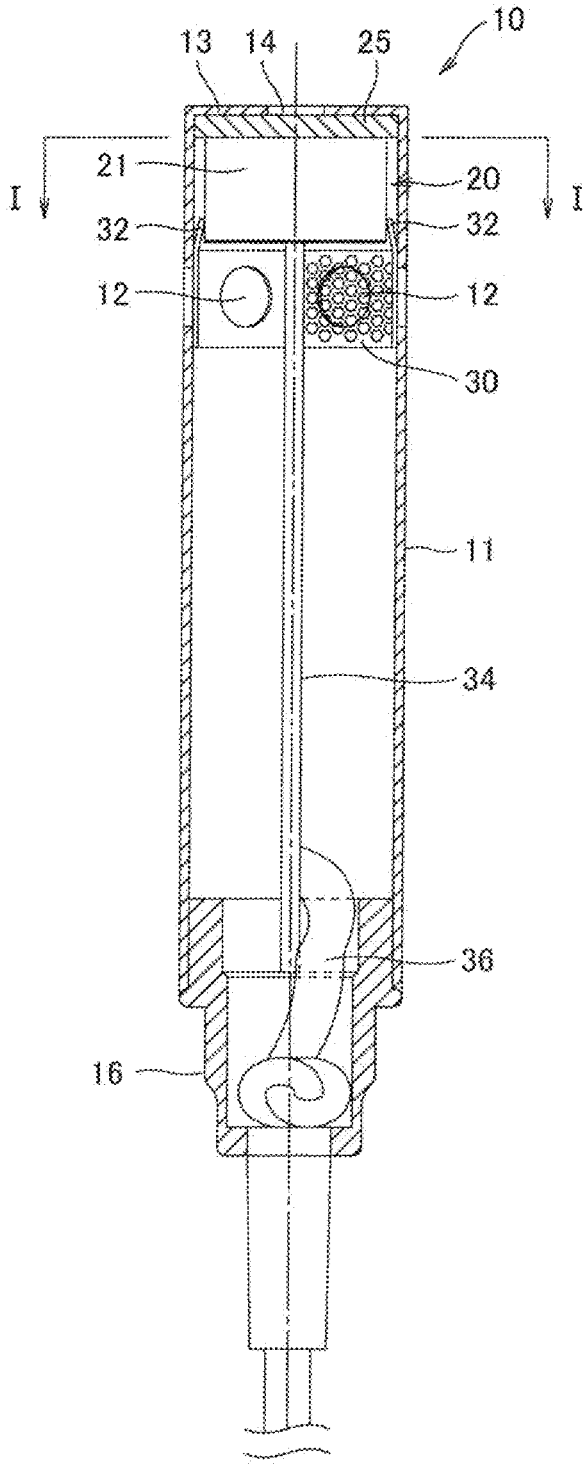
FIG. 1 is a longitudinal cross-sectional view of an embodiment of a capacitor microphone according to the present invention.
Figure 2A:
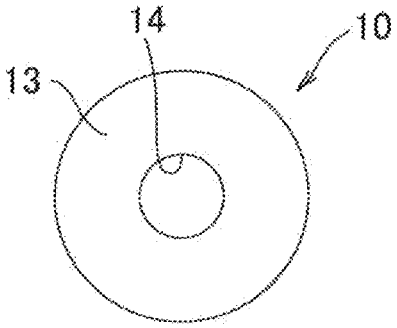
FIG. 2A is a top view of the embodiment.
Figure 2B:
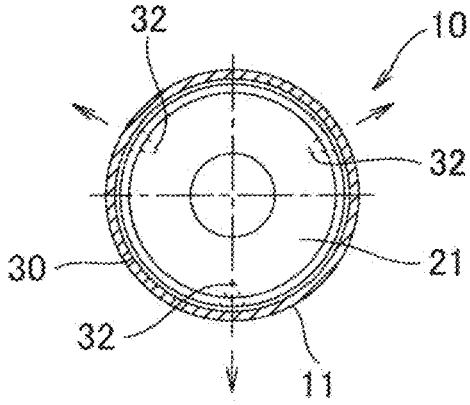
FIG. 2B is a cross sectional view of the embodiment taken along the lines I-I in FIG. 1.
Figure 3:
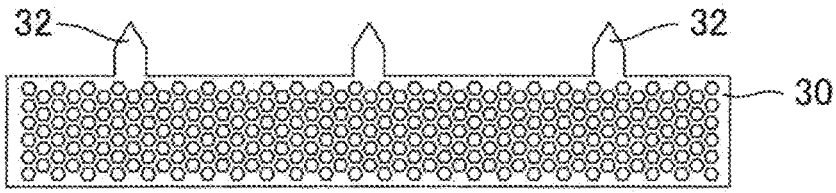
FIG. 3 is a development view of a shield plate in the embodiment.
Figure 4A:
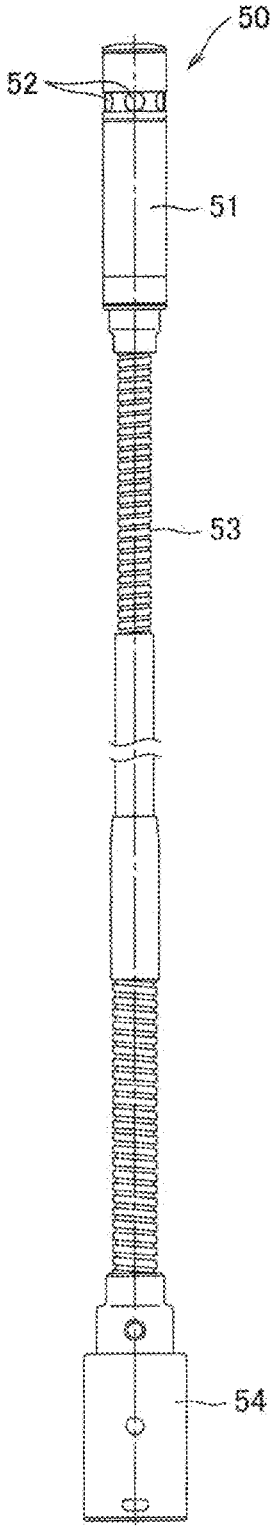
FIGS. 4A and 4B illustrate various types of a capacitor microphone.
Figure 4B:
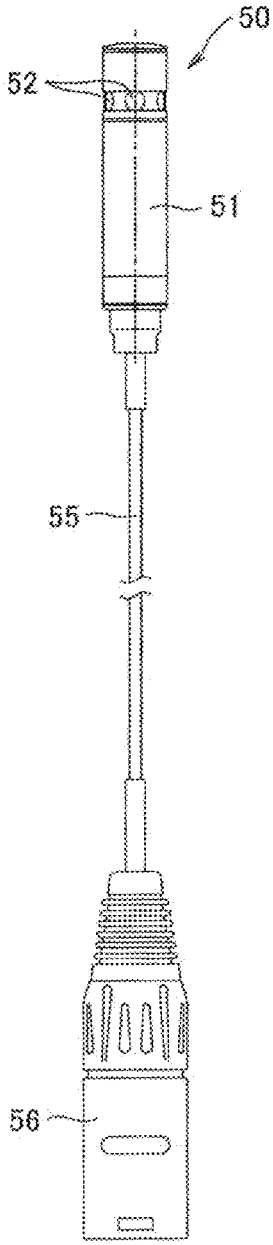

As illustrated in FIGS. 1 to 3, a capacitor microphone 10 includes: a microphone casing 11 being a cylindrical shape, being provided with an end plate 13 at the front end (upper end as viewed in FIG. 1), and being opened at the rear end; a damper 25 disposed along the inner surface of the end plate 13 of the microphone casing 11; and a capacitor microphone unit 20 disposed in the microphone casing 11 in a manner that the damper 25 is pressed against the inner surface of the end plate 13 therewith. The capacitor microphone unit 20 includes a unit casing 21 incorporating the elements as described in the conventional example. The feature of the present invention does not lie in the internal structure of the capacitor microphone unit 20 and the internal structure can be the same as that of the conventional example. Therefore, the detailed description thereof is omitted.

In the present embodiment, the capacitor microphone unit 20 is provided with a rear acoustic terminal, whereby the capacitor microphone 10 has unidirectionality. The rear acoustic terminal of the capacitor microphone unit 20 is communicated with the exterior via multiple openings 12 formed in the microphone casing 11 at portions nearer to the front end.

The area of the inner surface of the microphone casing 11 including the portions at which the openings 12 are provided is provided with a shield plate 30 illustrated in FIG. 3. In the present embodiment, the shield plate 30, which can take any form as long as electromagnetic waves can be shielded therewith, is a stainless steel plate having a thickness of about 0.1 mm. The shield plate 30 is etched to have multiple openings through which sound waves pass. As illustrated in FIG. 3, the shield plate 30 has an elongated rectangle shape with the length substantially the same with the inner perimeter of the microphone casing 11. The shield plate 30 is rolled into in the length direction into a cylinder shape to cover the openings 12 of the microphone casing 11 from the inside. The shield plate 30 is in contact with the inner surface of the microphone casing 11 at the area near the rear end of the capacitor microphone unit 20 by applying pressure to the contacted portion with the distending force thereof. The shield plate 30 has projections 32 at the side end closer to the capacitor microphone unit 20 in the axial direction of the microphone casing 11. The projections 32 extend in the axial direction of the microphone, casing 11 and are provided at equal intervals in the circumferential direction of the shield plate 30 rolled into a cylinder. The projections 32 of the shield plate 30 are each folded in such a direction to be pressed firmly against the outer peripheral surface of the unit casing 21 of the capacitor microphone unit 20. Thus, the projections 32 are each folded in a slanted angle towards the inner side in the radial direction of the shield plate 30 rolled into a cylinder to be arranged along the inner surface of the microphone casing 11. In this manner, the projections 32 are each pressed firmly against the outer surface of the unit casing 21.

The capacitor microphone unit 20 is disposed in the microphone casing 11 in a manner that the damper 25 is compressed thereby. Thus, the capacitor microphone unit 20 is pushed back by the compressing force of the damper 25. The capacitor microphone unit 20 being pushed back applies force for enlarging a diameter of the shield plate 30 on the projection 32 of the shield plate 30 that is connected by pressure to the outer surface of the unit casing 21 in a wedging manner as indicated by arrows in FIG. 2B. Thus, the shield plate 30 is in contact with the inner surface of the microphone casing 11 by pressure to be in close contact with the area of the microphone casing 11 including the portions at which the openings 12 are formed. Accordingly, electromagnetic waves can be surely prevented from entering through the openings 12, thereby improving the shielding effect. In addition, the unit casing 21 and the microphone casing 11 are electrically conducted for sure with the shield plate 30 interposed therebetween. Accordingly, the capacitor microphone unit 20 can also have improved shielding effect.

Figure 5A:
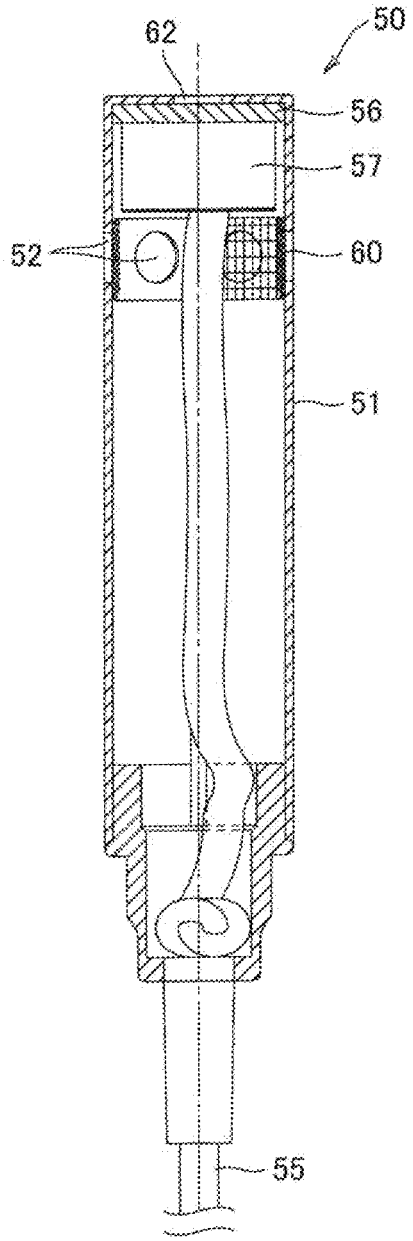
FIG. 5A is a longitudinal cross-sectional view of an example of a conventional capacitor microphone.
Figure 5B:
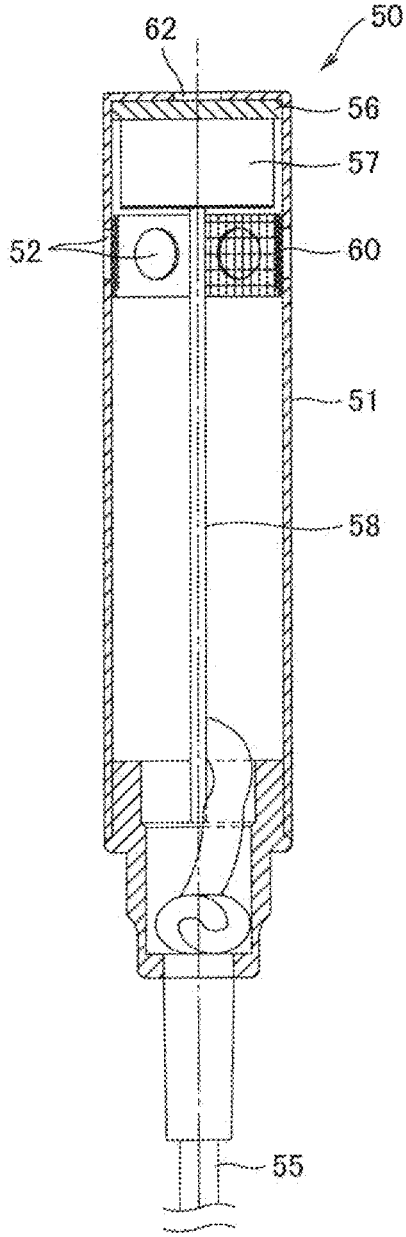
FIG. 5B is a longitudinal cross-sectional view of another example of a conventional capacitor microphone.
Figure 5C:
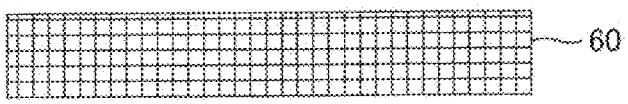
FIG. 5C is a development view of a shield mesh used in a conventional capacitor microphone.
Figure 6:
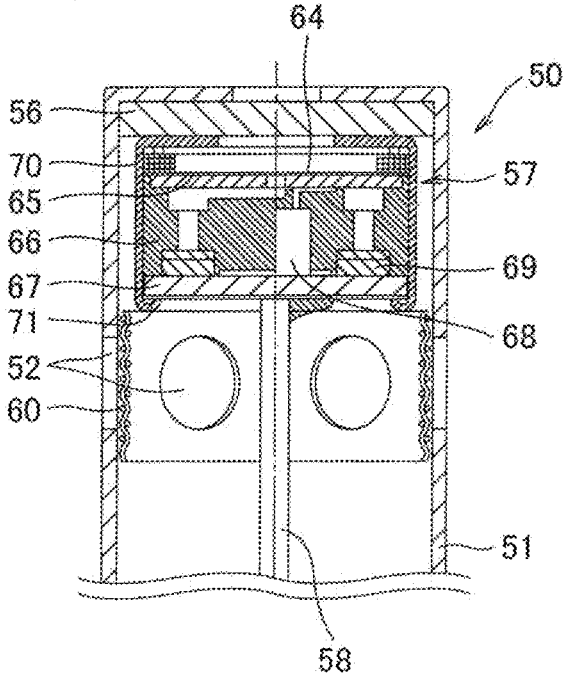
FIG. 6 is an enlarged longitudinal cross-sectional view of a main portion of an example of a conventional capacitor microphone.
Figure 7:
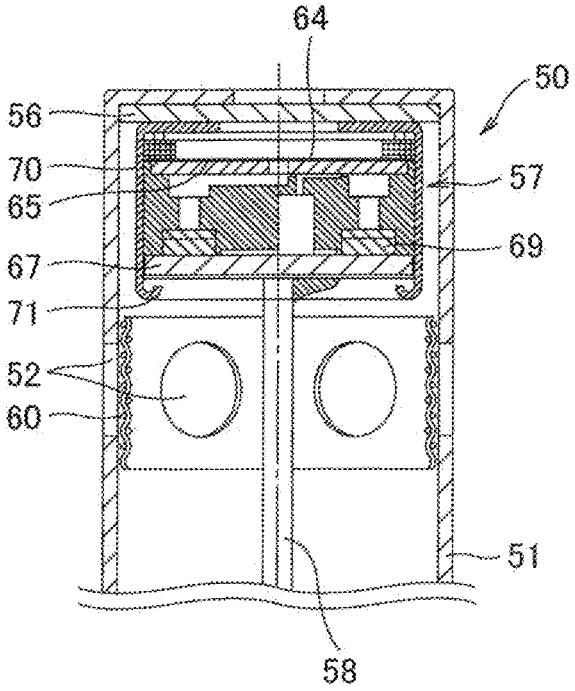
FIG. 7 is a longitudinal cross-sectional view of the main portion of the conventional example illustrated in FIG. 6 in another state.

In the embodiment illustrated in FIG. 1, one end of the circuit substrate 34 is in abutting contact with the rear end surface of the capacitor microphone unit 20 in a direction perpendicular to each other and the sound signal is output through the wires 36, connecting to the other end of the circuit substrate 34 and penetrating the bush 16 as in the conventional example illustrated in FIG. 5B. The projections 32 of the shield plate 30 pressed firmly against the unit casing 21 of the capacitor microphone unit 20 prevents the capacitor microphone unit 20 from moving towards the front when the pressing force towards the front is applied to the unit casing 21 of the capacitor microphone unit 20 via the circuit substrate 34. The projections 32 of the shield plate 30 pressed firmly against the unit casing 21 of the capacitor microphone unit 20 also prevents the capacitor microphone unit 20 from moving towards the rear when the pulling force towards the rear is applied to the unit casing 21 of the capacitor microphone unit 20 via the circuit substrate 34. Thus, the movement of the capacitor microphone unit 20 is prevented with the shield plate 30 having the projections 32 serving as a stopper, whereby the degradation of the shielding effect and the change in acoustic characteristics due to the movement of the capacitor microphone unit 20 can be prevented.

The terminal plate 13 at the front end of the microphone casing 11 is provided with an opening serving as the front acoustic terminal 14 through which sound waves are guided to the capacitor microphone unit 20 (see, FIG. 1 and FIG. 2A). The damper 25 is provided between the front acoustic terminal 14 and the capacitor microphone unit 20 and also serves as an acoustic resister. The shielding effect can be improved even further by forming the damper 25 with a conductive material to block electromagnetic waves entering from the front side of the capacitor microphone unit 20.

The projections 32 of the shield plate 30, which are formed only on the capacitor microphone unit 20 side in the axial direction of the microphone casing 11 in the above description, can also be formed at the opposite side of the shield plate 30. The projections on the other side, which extends in the direction away from the capacitor microphone unit 20, can be folded to be pressed firmly against the inner surface of the microphone casing 11.

The capacitor microphone according to the present invention can be expected to be in demand for relatively high class microphones that should not have noise due to electromagnetic waves mixing to their outputs.

What is claimed is:

1. A capacitor microphone comprising:

a capacitor microphone unit;

a microphone casing that incorporates the capacitor microphone unit and is provided with an opening communicating with a rear acoustic terminal of the capacitor microphone unit; and a shield plate that covers the opening in the microphone casing from inside of the microphone casing, wherein the shield plate has a projection with a discontinuous flange extending towards an axial direction of the microphone casing on at least one side of the capacitor microphone unit in the axial direction of the microphone casing, and wherein the projection is folded in a direction to be pressed firmly against the outer peripheral surface of the microphone casing of the capacitor microphone unit.

2. The capacitor microphone according to claim 1, wherein the shield plate is rolled into a cylinder and is in contact with the inner surface of the microphone casing by pressure.

3. The capacitor microphone according to claim 1, wherein the microphone casing includes an end plate and the capacitor microphone unit is disposed on the end plate with a damper interposed therebetween.

4. The capacitor microphone according to claim 3, wherein the damper is disposed in the microphone casing while being compressed by the capacitor microphone unit.

5. The capacitor microphone according to claim 4, wherein the shield plate is in contact with an inner surface of the microphone casing with pressure generated by enlarging a diameter of the shield plate with the capacitor microphone unit pushing the projection of the shield plate by being applied with restitution force from the damper.

6. The capacitor microphone according to claim 1, wherein the shield plate is a metal plate on which etching is performed to provide a plurality of holes through which sound wave pass.

7. The capacitor microphone according to claim 4, wherein the damper is made of a conductive material and has shielding property.

8. The capacitor microphone according to claim 2, wherein the projection is provided in a plurality at equal intervals in circumferential direction of the shield plate rolled into a cylinder.

* * * * *